US010395618B2

(12) United States Patent
Lee et al.

(10) Patent No.: US 10,395,618 B2
(45) Date of Patent: Aug. 27, 2019

(54) DISPLAY APPARATUS HAVING SIGNAL DELAY COMPENSATION

(71) Applicant: Samsung Display Co., Ltd., Yongin-si, Gyeonggi-Do (KR)

(72) Inventors: Jongjae Lee, Hwaseong-si (KR); Ikhyun Ahn, Hwaseong-si (KR); Bongim Park, Asan-si (KR); Dongwon Park, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/152,771

(22) Filed: Oct. 5, 2018

(65) Prior Publication Data

US 2019/0035353 A1 Jan. 31, 2019

Related U.S. Application Data

(63) Continuation of application No. 14/996,314, filed on Jan. 15, 2016, now Pat. No. 10,109,253.

(30) Foreign Application Priority Data

Jan. 15, 2015 (KR) ..... 10-2015-0007271

(51) Int. Cl.

| | |
|---|---|
| ***G09G 3/36*** | (2006.01) |
| ***G09G 3/3266*** | (2016.01) |
| ***G09G 3/00*** | (2006.01) |

(52) U.S. Cl.

CPC ..... *G09G 3/3696* (2013.01); *G09G 3/003* (2013.01); *G09G 3/3266* (2013.01); (Continued)

(58) Field of Classification Search

CPC . G09G 3/36; G09G 5/00; G11C 19/00; G02F 1/1345; G06F 3/038

See application file for complete search history.

(56) References Cited

U.S. PATENT DOCUMENTS

2002/0027540 A1* 3/2002 Lee ..... G09G 3/3648 345/87
2004/0041778 A1* 3/2004 Hiraki ..... G09G 3/3688 345/100

(Continued)

FOREIGN PATENT DOCUMENTS

CN 102484471 A 5/2012
CN 103426388 A 12/2013

(Continued)

OTHER PUBLICATIONS

Extended European Search Report for Application No. 16151173.8-1903 dated Jun. 14, 2016.

(Continued)

*Primary Examiner* — Pegeman Karimi
(74) *Attorney, Agent, or Firm* — Cantor Colburn LLP

(57) ABSTRACT

A display apparatus includes a controller which generates control signals and outputs image data, a compensating circuit which receives a portion of the control signals from the controller and generates a compensation signal, a voltage generating circuit which converts an input voltage to a driving voltage and increases or decreases a voltage level of the driving voltage in a frame period in response to the compensation signal, a driving part which receives the control signals and the image data from the controller and receives the driving voltage from the voltage generating circuit to generate a panel driving signal, and a display panel which receives the panel driving signal from the driving part to display an image.

14 Claims, 13 Drawing Sheets

(52) U.S. Cl.
CPC ..... *G09G 3/3674* (2013.01); *G09G 3/3685* (2013.01); *G09G 2310/0243* (2013.01); *G09G 2310/0267* (2013.01); *G09G 2310/0278* (2013.01); *G09G 2310/0283* (2013.01); *G09G 2310/0289* (2013.01); *G09G 2320/02* (2013.01); *G09G 2320/0223* (2013.01); *G09G 2320/103* (2013.01); *G09G 2330/028* (2013.01)

(56) References Cited

U.S. PATENT DOCUMENTS

| | | | | |
|---|---|---|---|---|
| 2007/0132674 | A1 | 6/2007 | Tsuge | |
| 2008/0170064 | A1* | 7/2008 | Lee | G09G 3/3677 345/214 |
| 2009/0195526 | A1* | 8/2009 | Chen | G09G 3/3677 345/211 |
| 2011/0102409 | A1 | 5/2011 | Hayakawa | |
| 2012/0320056 | A1 | 12/2012 | Ann et al. | |
| 2013/0113844 | A1 | 5/2013 | Kim et al. | |
| 2013/0257400 | A1 | 10/2013 | Zhang et al. | |
| 2013/0314392 | A1 | 11/2013 | Kim | |

FOREIGN PATENT DOCUMENTS

| | | | |
|---|---|---|---|
| KR | 1020050096569 | A | 10/2005 |
| KR | 1020110075414 | A | 7/2011 |
| KR | 1020120057426 | A | 6/2012 |
| KR | 1020130035126 | A | 4/2013 |

OTHER PUBLICATIONS

Chinese Office Action for Application No. 201610028611.6 dated Jun. 25, 2019 enumerating the above references cited within the Chinese Office Action.

* cited by examiner

DISPLAY APPARATUS HAVING SIGNAL DELAY COMPENSATION

This application is a continuation of U.S. patent application Ser. No. 14/996,314, filed on Jan. 15, 2016, which claims priority to Korean Patent Application No. 10-2015-0007271, filed on Jan. 15, 2015, and all the benefits accruing therefrom under 35 U.S.C. § 119, the content of which in its entirety is herein incorporated by reference.

BACKGROUND

1. Field

The disclosure relates to a display apparatus. More particularly, the disclosure relates to a display apparatus in which delay of signals is compensated.

2. Description of the Related Art

In recent years, the market demand for large-scale display panels continues to increase. When a display device, such as a liquid crystal display, an organic electroluminescent display, etc., has large-scale and high-resolution, a line resistance of signal lines used to control pixels increases, and signals applied to a driver driving the pixels are delayed.

The delay time of the signals increases as a distance between a signal supply source and the driver increases. As the delay time increases, differences between a target grayscale of each pixel and an actual grayscale displayed in each pixel increases and become different according to positions on the display device. As a result, a display quality of the display device may be degraded.

SUMMARY

The disclosure provides a display apparatus with improved driving reliability and improved display quality, in which a gate signal is effectively prevented from being distorted according to a position thereof in a display panel.

Embodiments of the invention provide a display apparatus including a controller which generates control signals and outputs image data, a compensating circuit which receives a portion of the control signals from the controller and generates a compensation signal, a voltage generating circuit which converts an input voltage to a driving voltage and increases or decreases a voltage level of the driving voltage in a frame period in response to the compensation signal, a driving part which receives the control signals and the image data from the controller and receives the driving voltage from the voltage generating circuit to generate a panel driving signal, and a display panel which receives the panel driving signal from the driving part to display an image.

Embodiments of the invention provide a display apparatus including a display panel which displays an image using a light, a switching panel which controls liquid crystal molecules to allow the display panel to operate in a two-dimensional mode or a three-dimensional mode and the image displayed in the display panel to be recognized as a two-dimensional image or a three-dimensional image, a first driver which drives the display panel, a second driver which drives the switching panel, and a controller which controls the first and second drivers.

In such an embodiment, the first driver includes a compensating circuit which receives control signals from the controller and generates a compensation signal, a voltage generating circuit which converts an input voltage to a driving voltage and increases or decreases a voltage level of the driving voltage in a frame period in response to the compensation signal, and a panel driving part which receives the control signals and image data from the controller and receives the driving voltage from the voltage generating circuit to generate a panel driving signal.

According to exemplary embodiments described herein, the gate-on voltage and the gate-off voltage are non-linearly varied according to the time period, and thus the gate signal is effectively prevented from being distorted according to positions thereof in the display panel. Thus, in such an embodiment, a driving reliability and a display quality of the display apparatus are substantially improved.

BRIEF DESCRIPTION OF THE DRAWINGS

The above and other features of the disclosure will become readily apparent by reference to the following detailed description when considered in conjunction with the accompanying drawings, in which.

DETAILED DESCRIPTION

Figure 1:
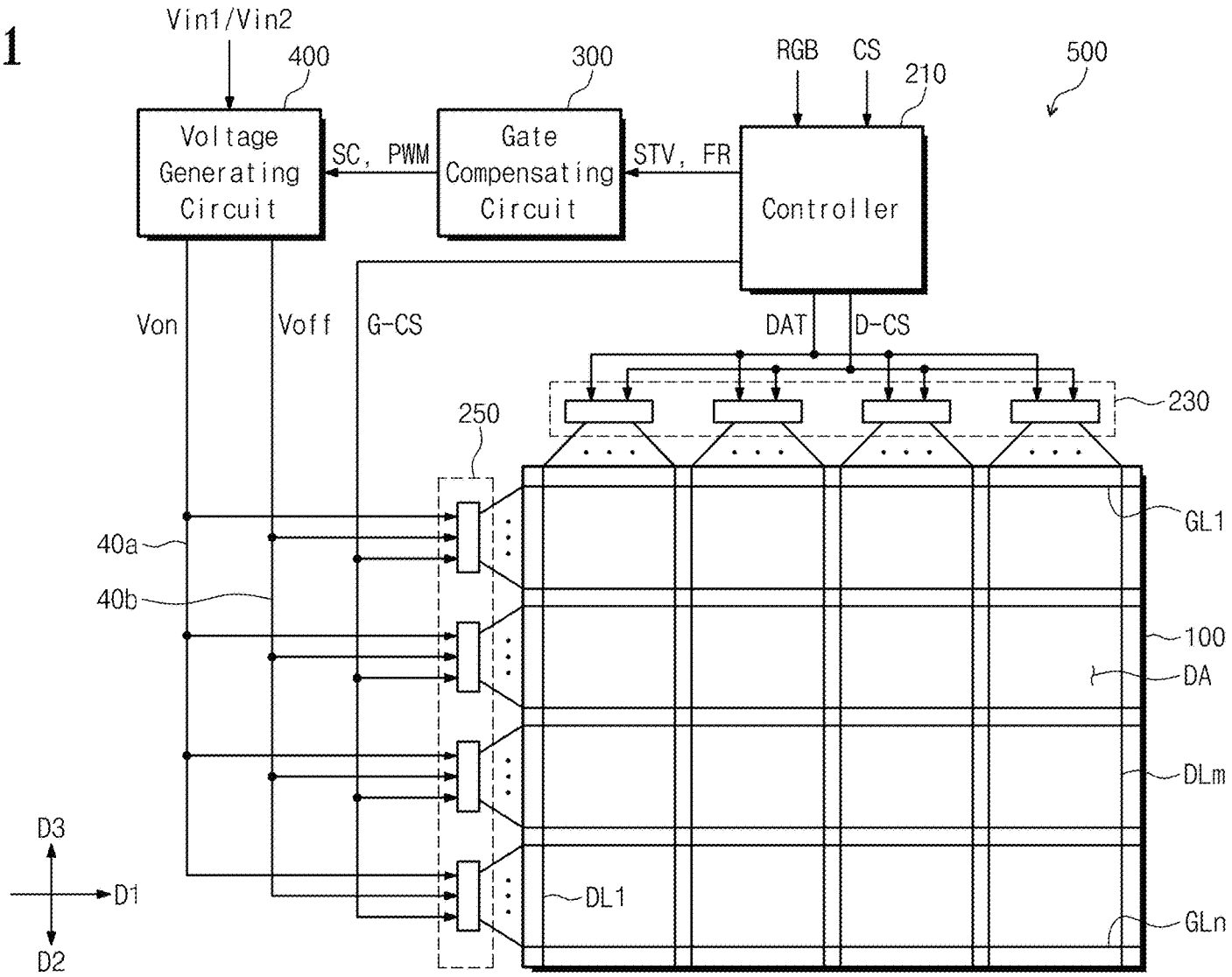
FIG. 1 is a block diagram showing an exemplary embodiment of a display apparatus according to the invention.

The invention now will be described more fully hereinafter with reference to the accompanying drawings, in which various embodiments are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the invention will be described in detail with reference to the accompanying drawings.

Figure 2:
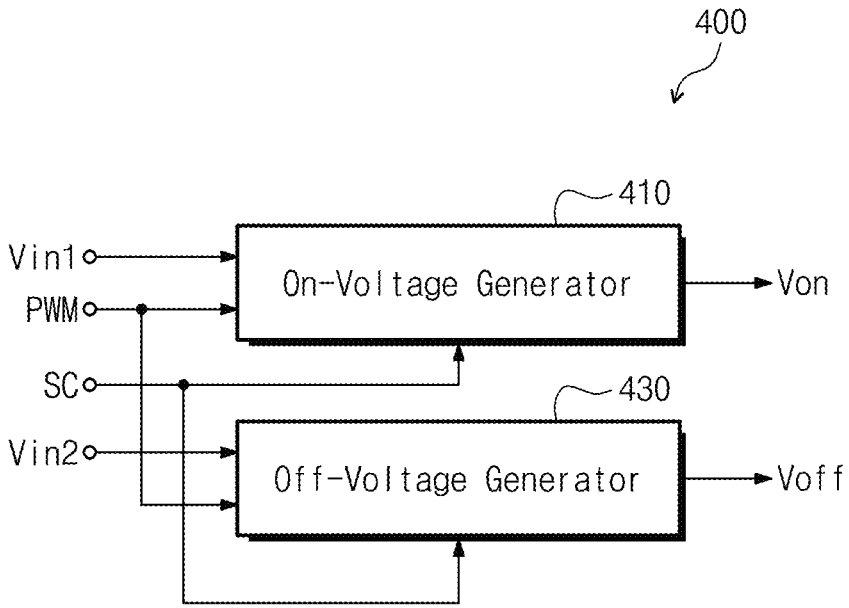
FIG. 2 is a block diagram showing an exemplary embodiment of a voltage generating circuit shown in FIG. 1.

FIG. 1 is a block diagram showing an exemplary embodiment of a display apparatus 500 according to the invention, and FIG. 2 is a block diagram showing a voltage generating circuit 400 shown in FIG. 1.

Referring to FIG. 1, an exemplary embodiment of the display apparatus 500 includes a controller 210, a gate compensating circuit 300, a voltage generating circuit 400, a data driver 230, a gate driver 250 and a display panel 100.

The display panel 100 may be, but not limited to, a flat display panel, such as a liquid crystal display panel, a plasma display panel and an electroluminescence device including an organic light emitting diode, for example.

In an exemplary embodiment, where the display panel 100 is the liquid crystal display panel, the display apparatus 500 may further includes a backlight unit (not shown) disposed under the display panel 100. In such an embodiment, a lower polarizing film may be disposed between the display panel 100 and the backlight unit and an upper polarizing film may be disposed on the display panel 100. Hereinafter, an exemplary embodiment where the display panel 100 is the liquid crystal display panel will be described in greater detail.

In such an embodiment, the display panel 100 includes a lower substrate, an upper substrate disposed opposite to the lower substrate, and a liquid crystal layer interposed between the lower substrate and the upper substrate. The lower substrate includes a plurality of pixels, and the upper substrate includes color filters corresponding to the pixels, respectively. The color filters may include red, green and blue color filters that display primary colors of red, green and blue colors, respectively. The color filters may further include color filters that display colors other than the primary colors. The upper polarizing film may be attached to the upper substrate and the lower polarizing film may be attached to the lower substrate.

A display area DA of the display panel 100 includes a plurality of gate lines, e.g., first to n-th gate liens GL1 to GLn, a plurality of data lines, e.g., first to m-th data lines DL1 to DLm, and a plurality of pixels. Here, n and m are natural numbers. In such an embodiment, the gate lines GL1 to GLn extend substantially in a first direction D1 and are arranged substantially in a second direction D2 substantially perpendicular to the first direction D1. The data lines DL1 to DLm extend substantially in the second direction D2 and are arranged substantially in the first direction D1. The data lines DL1 to DLm are disposed on a layer different from a layer on which the gate lines GL1 to GLn are disposed and electrically insulated from the gate lines GL1 to GLn.

The display area DA includes a plurality of pixel areas defined therein. The pixels are respectively arranged in the pixel areas, and each pixel includes a thin film transistor and a liquid crystal capacitor. The liquid crystal capacitor includes a first electrode and a second electrode, and the liquid crystal layer is disposed between the first and second electrodes as a dielectric substance.

In an exemplary, the gate lines GL1 to GLn, the data lines DL1 to DLm, the thin film transistor of each pixel and a pixel electrode that defines the first electrode of the liquid crystal capacitor are disposed on the lower substrate. In such an embodiment, a reference electrode or a common electrode that defines the second electrode of the liquid crystal capacitor is disposed on the upper substrate.

In an exemplary embodiment, a plurality of pixel electrodes is disposed on the lower substrate to correspond to the pixels in a one-to-one correspondence. Each pixel electrode receives a data voltage through a corresponding thin film transistor. The reference electrode is disposed on the upper substrate as a single unitary and individual unit to face the pixel electrodes. The reference electrode is applied with a reference voltage. An electric field may be generated between the reference electrode and each pixel electrode due to a difference in electric potential between the data voltage and the reference voltage, and the liquid crystal layer controls a transmittance of light passing therethrough based on alignment of liquid crystal materials therein corresponding to an intensity of the electric field.

In an exemplary embodiment, the controller 210 receives image signals RGB and control signals CS from the outside of the display apparatus 500. The controller 210 converts the image signals RGB to image data DAT in consideration of an interface between the data driver 230 and the controller 210, and applies the image data DAT to the data driver 230. In such an embodiment, the controller 210 generates a data control signal D-CS including an output start signal, a horizontal start signal, etc., and a gate control signal G-CS including a vertical start signal, a vertical clock signal, a vertical clock bar signal, etc., based on the control signals CS. The data control signal D-CS is applied to the data driver 230, and the gate control signal G-CS is applied to the gate driver 250.

The gate driver 250 sequentially outputs gate signals in response to the gate control signal G-CS provided from the controller 210. Accordingly, the pixels are sequentially scanned by the gate signals in the unit of row or in a row-by-row basis. In one exemplary embodiment, for example, the gate driver 250 includes a plurality of chips, each of which is connected to a corresponding gate line of the gate lines GL1 to GLn. In an exemplary embodiment, the gate driver 250 may be directly disposed on the display panel 100, e.g., directly formed on the display panel 100 through a thin film process. In such an embodiment, the gate driver 250 includes a shift register, and the shift register includes a plurality of stages connected one after another to each other or in a cascade manner. When the stages sequentially operate, the gate signals are sequentially applied to the gate lines GL1 to GLn.

The data driver 230 converts the image data DAT to data voltages in response to the data control signal D-CS provided from the controller 210, and the data voltages are applied to the display panel 100. In an exemplary embodiment, the data driver 230 includes a plurality of chips, each of which is connected to a corresponding data line of the data lines DL1 to DLm.

Therefore, each pixel is turned on in response to the corresponding gate signal of the gate signals, and the turned-on pixel receives the corresponding data voltage from the data driver 230 to display an image of a desired grayscale.

The voltage generating circuit 400 receives a first input voltage Vin1 and a second input voltage Vin2 from an external source (not shown) and converts the first and second input voltages Vin1 and Vin2 to voltages to drive the gate driver 250 and the data driver 230. Hereinafter, a block of the voltage generating circuit 400, which generates voltages, e.g., a gate-on voltage Von and a gate-off voltage Voff to drive the gate driver 250, will be described in detail. The gate-on voltage Von determines a high level of the gate signal, and the gate-off voltage Voff determines a low level of the gate signal.

The display apparatus 500 further includes the gate compensating circuit 300 that compensates the gate-on voltage Von and the gate-off voltage Voff, which are generated by the voltage generating circuit 400.

The gate compensating circuit 300 receives various control signals from the controller 210 for the compensation. The control signals from the controller 210 include the vertical start signal STV and a frame rate signal FR.

The gate compensating circuit 300 generates a compensation signal based on the control signals from the controller 210 to compensate the gate-on voltage Von and the gate-off voltage Voff. The compensation signal may include, but not limited to, a pulse width modulation signal PWM. The gate compensating circuit 300 controls a duty ratio of the pulse width modulation signal PWM and applies the controlled pulse width modulation signal PWM to the voltage generating circuit 400.

In an exemplary embodiment, as shown in FIG. 2, the voltage generating circuit 400 includes an on-voltage generator 410 generating the gate-on voltage Von and an off-voltage generator 430 generating the gate-off voltage Voff. The on-voltage generator 410 converts the first input voltage Vin1 to the gate-on voltage Von based on the pulse width modulation signal PWM. The off-voltage generator 430 converts the second input voltage Vin2 to the gate-off voltage Voff based on the pulse width modulation signal PWM.

The compensation signal may further include a compensation control signal SC. The gate compensating circuit 300 applies the compensation control signal SC to the on-voltage generator 410 and the off-voltage generator 430 of the voltage generating circuit 400 to determine compensation and restoration timings of each of the gate-on voltage Von and the gate-off voltage Voff.

In an exemplary embodiment, as shown in FIG. 2, the on-voltage generator 410 and the off-voltage generator 430 receive the same pulse width modulation signal PWM, but not being limited thereto. In an alternative exemplary embodiment, the on-voltage generator 410 and the off-voltage generator 430 may receive different pulse width modulation signals from each other.

Hereinafter, an exemplary embodiment, where the on-voltage generator 410 and the off-voltage generator 430 receive the same compensation control signal SC as shown in FIG. 2, will be described, but not being limited thereto. In an alternative exemplary embodiment, the on-voltage generator 410 and the off-voltage generator 430 may receive different compensation control signals from each other.

In an exemplary embodiment, as shown in FIG. 1, the voltage generating circuit 400 applies the gate-on voltage Von and the gate-off voltage Voff to the gate driver 250 through a first connection line 40*a* and a second connection line 40*b*, which are connected between the gate driver 250 and the voltage generating circuit 400. In such an embodiment, an electric potential of the gate-on voltage Von and the gate-off voltage Voff may vary in accordance with a distance between the voltage generating circuit 400 and the driving chips or stages in the gate driver 250 since a line resistance of the first and second connection lines 40*a* and 40*b* varies depending on a length of the first and second connection lines 40*a* and 40*b*. In an exemplary embodiment, voltage generating circuit 400 may be disposed adjacent to one of the first to n-th gate lines GL1 to GLn.

In an exemplary embodiment, the voltage generating circuit 400 variably changes the electric potential of the gate-on voltage Von and the gate-off voltage Voff in accordance with the distance between the gate driver 250 and the voltage generating circuit 400. Thus, in such an embodiment, the driving chip or the stages may receive the gate-on voltage Von and the gate-off voltage Voff, which have a constant electric potential, regardless of the distance between the gate driver 250 and the voltage generating circuit 400.

The gate driver 250 sequentially performs the scanning operation from the first gate line GL1 to the n-th gate line GLn along the second direction D2 or from the n-th gate line GLn to the first gate line GL1 along a third direction D3 opposite to the second direction D2. Hereinafter, the scanning operation performed along the second direction D2 by the gate driver 250 is referred to as a positive scan, and the scanning operation performed along the third direction D3 by the gate driver 250 is referred to as a negative scan.

Hereinafter, an exemplary embodiment of the voltage generating circuit 400 shown in FIG. 2 will be described in detail with reference to FIGS. 3 and 4.

According to an exemplary embodiment, the gate driver 250 may perform the scanning operation along only one predetermined direction, e.g., one of the positive scan operation and the negative scan operation, during a frame period, but not being limited thereto or thereby.

Hereinafter, an exemplary embodiment of the voltage generating circuit 400 that generates the gate-on voltage Von and the gate-off voltage Voff, which are differently compensated by the positive or negative scan operation of the gate driver 250, will be described in detail.

Figure 3:
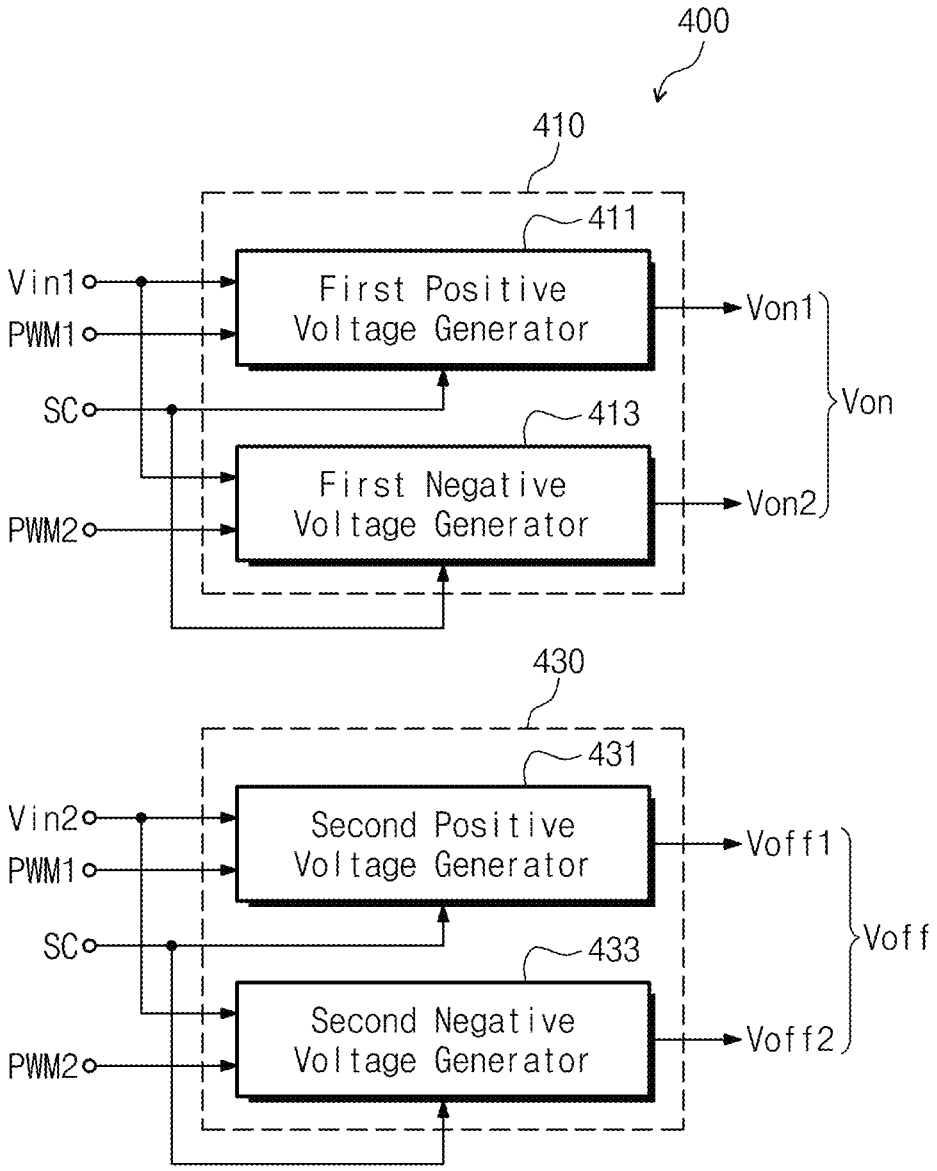
FIG. 3 is a block diagram showing an exemplary embodiment of an on-voltage generator and an off-voltage generator shown in FIG. 2.

FIG. 3 is a block diagram showing an exemplary embodiment of the on-voltage generator 410 and the off-voltage generator 430 shown in FIG. 2.

Referring to FIG. 3, the voltage generating circuit 400 includes the on-voltage generator 410 and the off-voltage generator 430. The on-voltage generator 410 includes a first positive voltage generator 411 that operates during the positive scan operation and a first negative voltage generator 413 that operates during the negative scan operation. The off-voltage generator 430 includes a second positive voltage generator 431 that operates during the positive scan operation and a second negative voltage generator 433 that operates during the negative scan operation.

The on-voltage generator 410 receives the first input voltage Vin1 and boosts the first input voltage Vin1 to output a first gate-on voltage Von1 or a second gate-on voltage Von2. Here, the voltage output from the first positive voltage generator 411 is referred to as the first gate-on voltage Von1 and the voltage output from the first negative voltage generator 413 is referred to as the second gate-on voltage Von2.

The off-voltage generator 430 receives the second input voltage Vin2 and decreases the second input voltage Vin2 to output the first gate-off voltage Voff1 or a second gate-off voltage Voff2. Here, the voltage output from the second positive voltage generator 431 is referred to as the first gate-off voltage Voff1 and the voltage output from the second negative voltage generator 433 is referred to as the second gate-off voltage Voff2.

In an exemplary embodiment, the first positive voltage generator 411 and the first negative voltage generator 413 may not simultaneously operate, and only one of the first positive voltage generator 411 and the first negative voltage generator 413 may operate in response to the scan operation of the gate driver 250. In such an embodiment, the controller 210 applies a scan direction signal to the voltage generating circuit 400 based on the scan direction to select one of the first positive voltage generator 411 and the first negative voltage generator 413 and to select one of the second positive voltage generator 431 and the second negative voltage generator 433.

During the positive scan operation, the first positive voltage generator 411 receives a first pulse width modulation signal PWM1 and the compensation control signal SC from the gate compensating circuit 300 (refer to FIG. 1), and the second positive voltage generator 431 receives the first pulse width modulation signal PWM1 and the compensation control signal SC from the gate compensating circuit 300 (refer to FIG. 1).

During the negative scan operation, the first negative voltage generator 413 receives a second pulse width modulation signal PWM2 and the compensation control signal SC from the gate compensating circuit 300 (refer to FIG. 1), and the second negative voltage generator 433 receives the second pulse width modulation signal PWM2 and the compensation control signal SC from the gate compensating circuit 300 (refer to FIG. 1).

Figure 4:
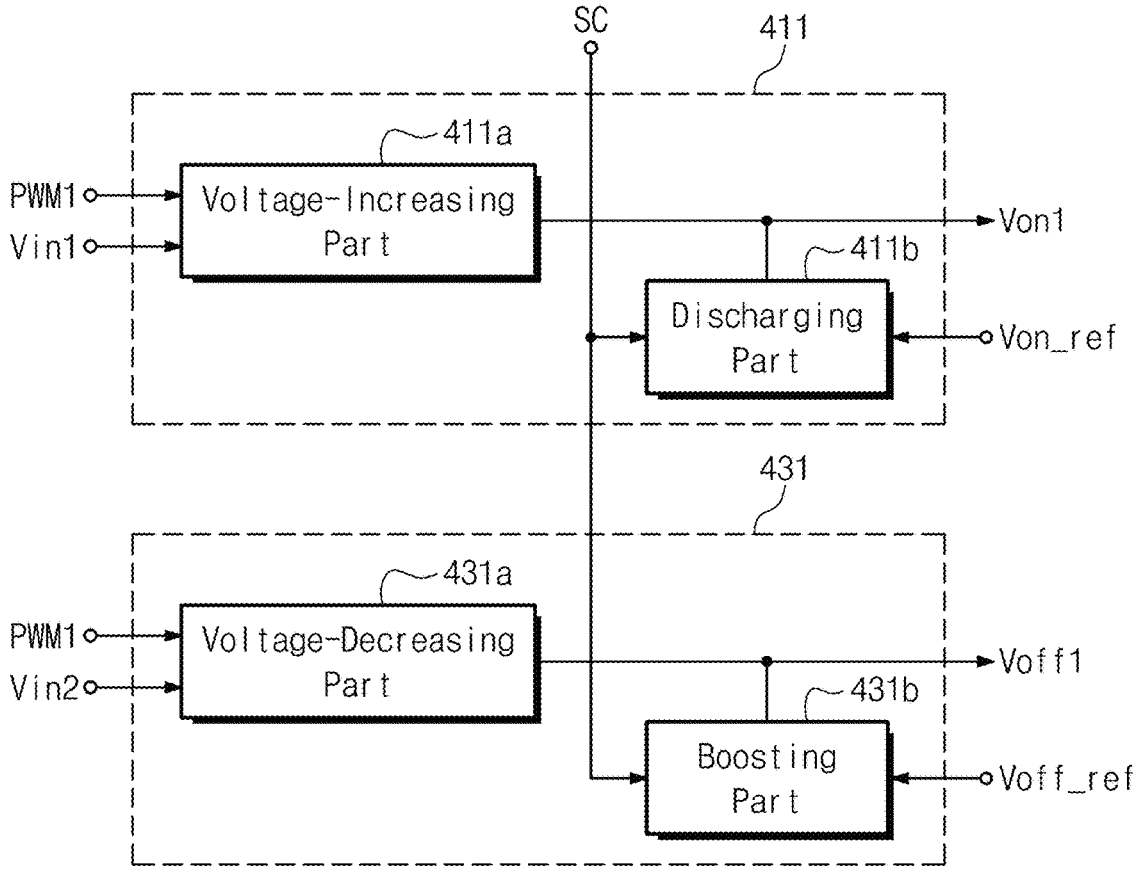
FIG. 4 is a block diagram showing an exemplary embodiment of first and second positive voltage generators shown in FIG. 3.
Figure 5:
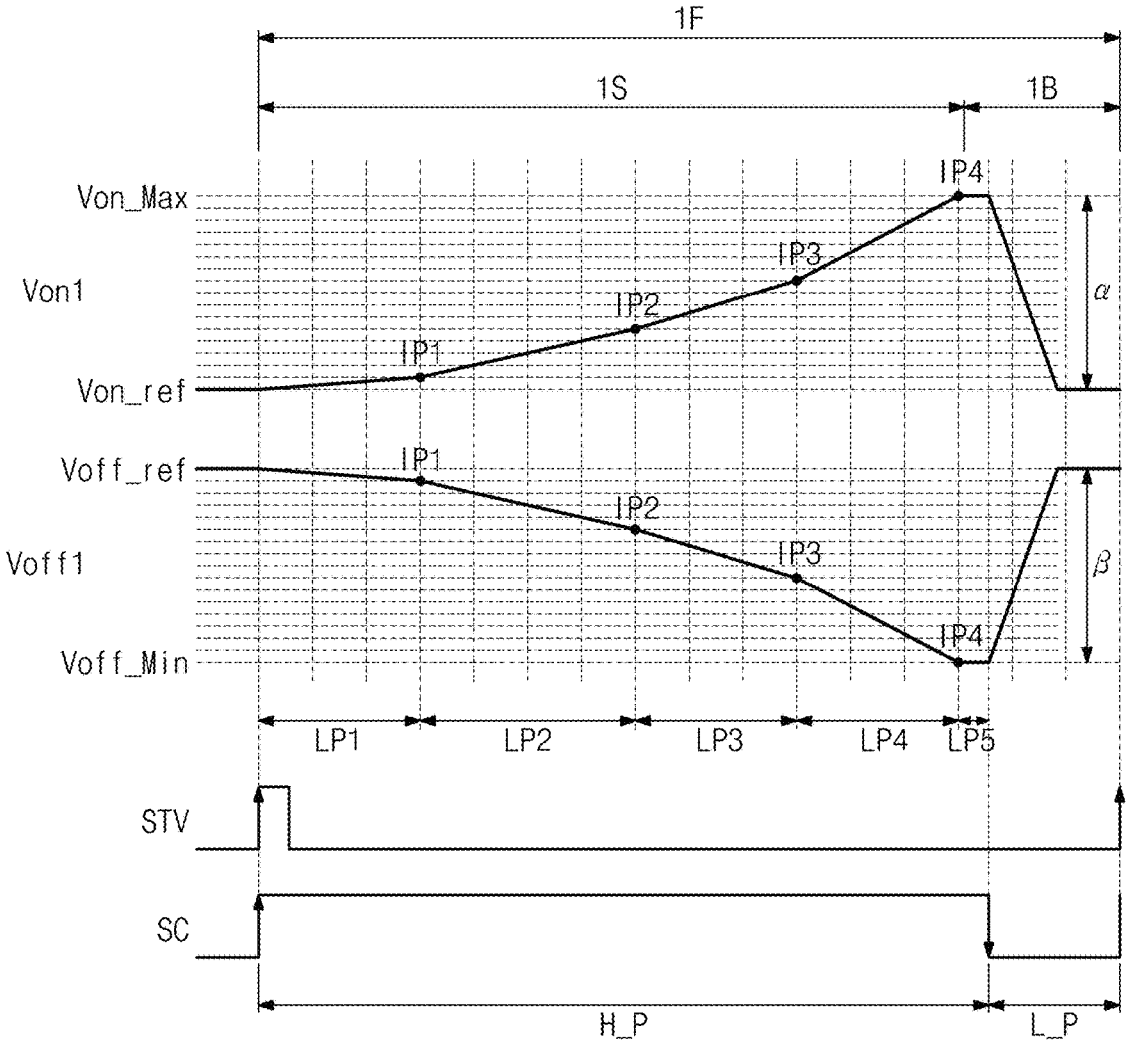
FIG. 5 is a waveform diagram showing an exemplary embodiment of a first gate-on voltage and a first gate-off voltage from the first and second positive voltage generators shown in FIG. 4.

FIG. 4 is a block diagram showing an exemplary embodiment of the first and second positive voltage generators shown in FIG. 3, and FIG. 5 is a waveform diagram showing an exemplary embodiment of the first gate-on voltage and the first gate-off voltage from the first and second positive voltage generators shown in FIG. 4.

Referring to FIGS. 4 and 5, in an exemplary embodiment, the first positive voltage generator 411 includes a voltage-increasing part 411*a* and a discharging part 411*b*. The voltage-increasing part 411*a* receives the first input voltage Vin1 and the first pulse width modulation signal PWM1 to convert the first input voltage Vin1 to the first gate-on voltage Von1. The voltage-increasing part 411*a* varies the first gate-on voltage Von1 in response to the first pulse width modulation signal PWM1 to allow the first gate-on voltage Von1 to be higher than a reference gate-on voltage Von_ref during a predetermined period of a frame period. The discharging part 411*b* discharges the first gate-on voltage Von1 to the reference gate-on voltage Von_ref before a next frame period starts.

In an exemplary embodiment, the second positive voltage generator 431 includes a voltage-decreasing part 431*a* and a boosting part 431*b*. The voltage-decreasing part 431*a* receives the second input voltage Vin2 and the first pulse width modulation signal PWM1 to convert the second input voltage Vin2 to the first gate-off voltage Voff1. The voltage-decreasing part 431*a* varies the first gate-off voltage Voff1 in response to the first pulse width modulation signal PWM1 to allow the first gate-off voltage Voff1 to be lower than a reference gate-off voltage Voff_ref during a predetermined period of a frame period 1F. The boosting part 431*b* boosts the first gate-off voltage Voff1 to the reference gate-off voltage Voff_ref before the next frame period starts.

As shown in FIG. 5, the gate lines GL1 to GLn (refer to FIG. 1) are sequentially scanned from the first gate line GL1 to the n-th gate line GLn during the positive scan operation after a high period of the vertical start signal STV indicating the start of a scan period 1S the frame period 1F is generated.

The compensation control signal SC is generated at a high state or level in synchronization with a rising timing of the vertical start signal STV and transited to a low state or level at a predetermined timing before the next frame period starts. Here, a high period H_P of the compensation control signal SC corresponds to a compensation period in which the first gate-on voltage Von1 and the first gate-off voltage Voff1 are compensated, and a low period L_P of the compensation control signal SC corresponds to a discharging period of the first gate-on voltage Von1 and a boosting period of the first gate-off voltage Voff1.

The low period L_P of the compensation control signal SC is substantially equal to a blank period 1B between two successive frame periods or included in the blank period 1B. The gate lines GL1 to GLn are not scanned during the blank period 1B and signals applied to the gate lines GL1 to GLn are reset during the blank period 1B. Accordingly, the first gate-on voltage Von1 and the first gate gate-off voltage Voff1 are maintained as the reference gate-on voltage Von_ref and the reference gate-off voltage Voff_ref, respectively, during the low period L_P of the compensation control signal SC.

The duty ratio of the first pulse width modulation signal PWM1 is varied in the high period H_P of the compensation control signal SC. In one exemplary embodiment, for example, the first gate-on voltage Von1 has k inflection points, e.g., four inflection points including first to fourth infliction points IP1 to IP4 (k is an integer equal to or greater than 1) and is non-linearly increased during the high period H_P of the compensation control signal SC. The number of the inflection points IP1 to IP4 is determined depending on a specification of the display apparatus 500 and a number of driving chips.

The high period H_P of the compensation control signal SC is divided into k+1 linear periods LP1 to LP5, due to the k inflection points IP1 to IP4. The k inflection points IP1 to IP4 are respectively positioned at boundaries of the k+1 linear periods LP1 to LP5. A variation in voltage may be substantially constant, that is, the voltage may be substantially gradually increased or decreased, in each of the linear periods LP1 to LP5, and variations in voltage between two linear periods LP1 to LP5 adjacent to each other may be different from each other. In an exemplary embodiment, as shown in FIG. 5, the high period H_P of the compensation control signal SC includes five linear periods (hereinafter, referred to as first to fifth linear periods LP1 to LP5).

During a frame period 1F, the first gate-on voltage Von1 may have $2^x$ (x is an integer equal to or greater than 1) resolutions on a time axis. In an exemplary embodiment, as shown in FIG. 5, the value of x may be four. Therefore, the frame period 1F includes sixteen unit-time periods. In an exemplary embodiment, the number of the unit-time periods included in each of the first to fifth linear periods LP1 to LP5 may be constant or different. In an exemplary embodiment, as shown in FIG. 5, each of the first, third, and fourth linear periods LP1, LP3, and LP4 includes three unit-time periods and the second linear period LP2 includes four unit time periods.

As shown in FIG. 5, when a minimum electric potential of the first gate-on voltage Von1 in the high period H_P is the reference gate-on voltage Von_ref and a maximum electric potential of the first gate-on voltage Von1 in the high period H_P is a maximum gate-on voltage Von_Max, an electric potential period between the maximum gate-on voltage Von_Max and the reference gate-on voltage Von_ref may have $2^y$ (y is an integer equal to or greater than 1) resolutions in the high period H_P. In FIG. 5, the value of y is four. Therefore, the electric potential period between the maximum gate-on voltage Von_Max and the reference gate-on voltage Von_ref includes sixteen unit electric potential periods. When a difference value between the maximum gate-on voltage Von_Max and the reference gate-on voltage Von_ref is $\alpha$, an electric potential difference of about $\alpha/2^y$ occurs between the unit electric potential periods.

A slope of a curved line indicating the first gate-on voltage in the first linear period LP1 is about 1/3, a slope of the curved line indicating the first gate-on voltage in the second linear period LP2 is about 4/4, a slope of the curved line indicating the first gate-on voltage in the third linear period LP3 is about 4/3, and a slope of the curved line indicating the first gate-on voltage in the fourth linear period LP4 is about 7/3. That is, a variation in voltage per unit time period becomes different depending on each of the linear periods LP1 to LP5. As shown in FIG. 5, the fifth linear period LP5 may maintain the maximum gate-on voltage Von_Max.

Since the electric potential of the first gate-on voltage Von1 is determined depending on the duty ratio of the first pulse width signal PWM1, the duty ratio of the first pulse width signal PWM1 is varied every unit-time period. As described above, a variation in the duty ratio becomes different in each of the first to fifth linear periods LP1 to LP5.

In an exemplary embodiment, during a frame period 1F, the first gate-off voltage Voff1 may have $2^x$ resolutions on the time axis. That is, the resolution of the first gate-off voltage Voff1 on the time axis may be substantially equal to the resolution of the first gate-on voltage Von1 on the time axis. However, in an alternative exemplary embodiment, the resolution of the first gate-off voltage Voff1 on the time axis may be different from the resolution of the first gate-on voltage Von1 on the time axis.

When a minimum electric potential of the first gate-off voltage Voff1 in the high period H_P is a minimum gate-off voltage Voff_Min and a maximum electric potential of the first gate-off voltage Voff1 in the high period H_P is a reference gate-off voltage Voff_ref, an electric potential period between the minimum gate-off voltage Voff_Min and the reference gate-off voltage Voff_ref may have $2^y$ resolutions in the high period H_P. That is, the resolution of the first gate-off voltage Voff1 on the electric potential axis may be substantially equal to the resolution of the first gate-on voltage Von1 on the electric potential axis. However, in an alternative exemplary embodiment, the resolution of the first gate-off voltage Voff1 on the electric potential axis may be different from the resolution of the first gate-on voltage Von1 on the electric potential axis. When a difference value between the minimum gate-off voltage Voff_Min and the reference gate-off voltage Voff_ref is $\beta$, an electric potential difference of about $\beta/2^y$ occurs between the unit electric potential periods.

A slope of a curved line indicating the first gate-off voltage in the first linear period LP1 is about (−1/3), a slope of the curved line indicating the first gate-off voltage in the second linear period LP2 is about (−4/4), a slope of the curved line indicating the first gate-off voltage in the third linear period LP3 is about (−4/3), and a slope of the curved line indicating the first gate-off voltage in the fourth linear period LP4 is about (−7/3). That is, a variation in voltage per unit-time period becomes different depending on each of the linear periods LP1 to LP5. The fifth linear period LP5 may maintain the minimum gate-off voltage Voff_Min.

Since the electric potential of the first gate-off voltage Voff1 is determined depending on the duty ratio of the first pulse width signal PWM1, the duty ratio of the first pulse width signal PWM1 is varied every unit-time period. As described above, the variation in the duty ratio becomes different in each of the first to fifth linear periods LP1 to LP5.

Figure 6:
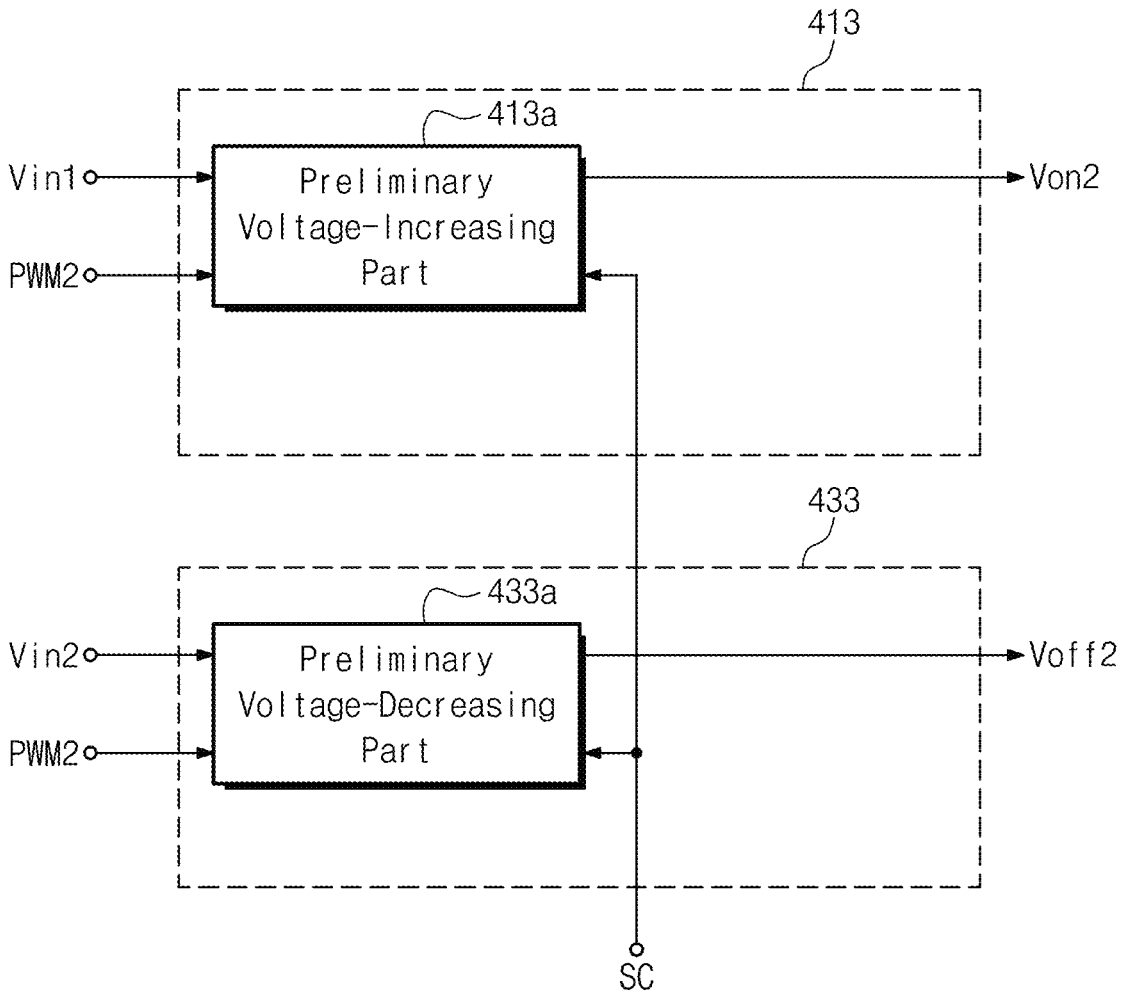
FIG. 6 is a block diagram showing an exemplary embodiment of a first negative voltage generator and a second negative voltage generator shown in FIG. 3.
Figure 7:
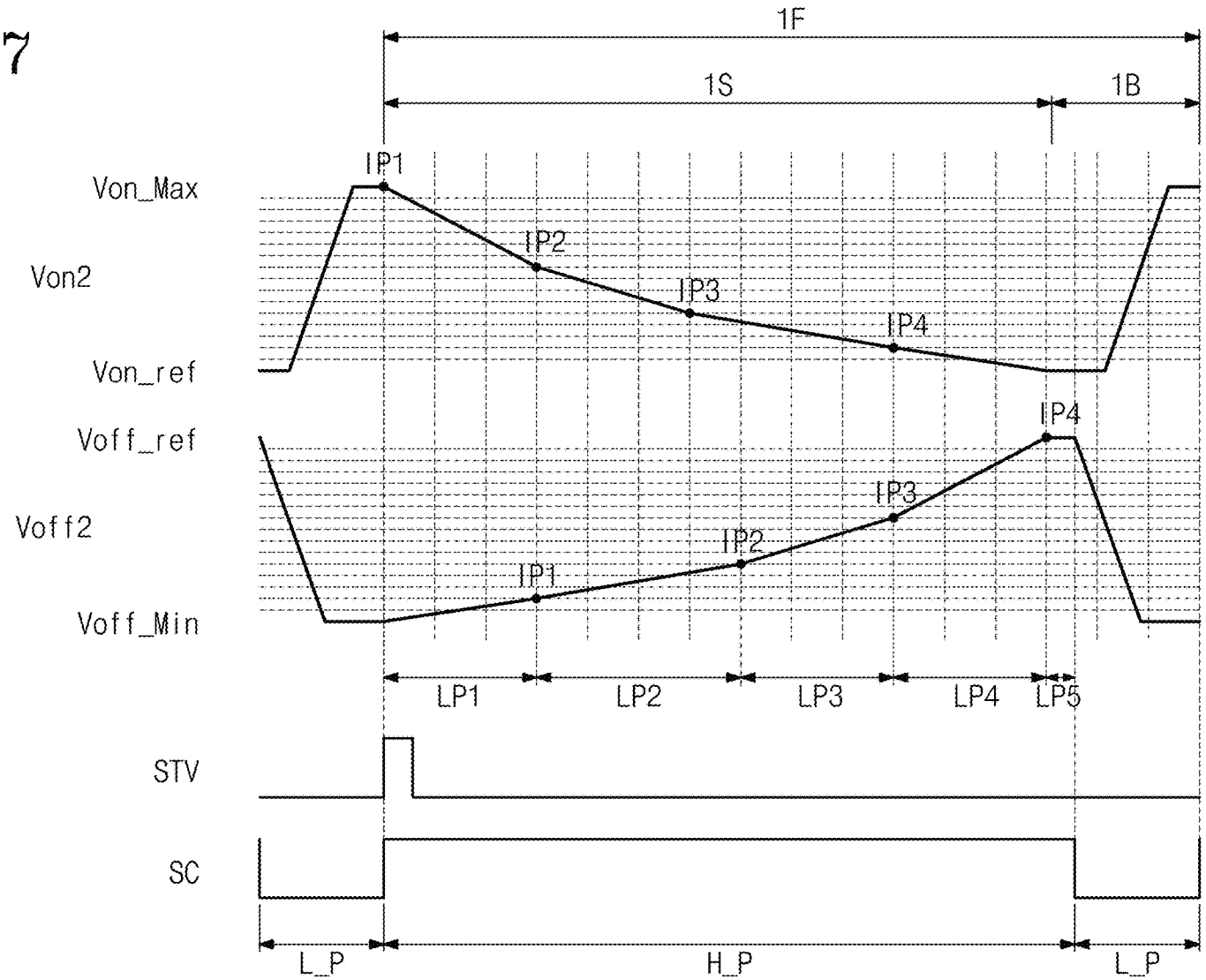
FIG. 7 is a waveform diagram showing an exemplary embodiment of a second gate-on voltage and a second gate-off voltage from the first and second negative voltage generators shown in FIG. 6.

FIG. 6 is a block diagram showing an exemplary embodiment of the first negative voltage generator and the second negative voltage generator shown in FIG. 3, and FIG. 7 is a waveform diagram showing an exemplary embodiment of the second gate-on voltage and the second gate-off voltage from the first and second negative voltage generators shown in FIG. 6.

Referring to FIG. 6, in an exemplary embodiment, the first negative voltage generator 413 includes a preliminary voltage-increasing part 413*a*, and the first negative voltage generator 413 operates when the gate driver 250 performs the negative scanning operation. The preliminary voltage-increasing part 413*a* receives the first input voltage Vin1 and the second pulse width modulation signal PWM2 to convert the first input voltage Vin1 to the second gate-on voltage Von2. The preliminary voltage-increasing part 413*a* boosts the second gate-on voltage Von2 to the maximum gate-on voltage Von_Max in response to the second pulse width modulation signal PWM2 during the blank period of a previous frame period before the frame period starts. Then, when the duty ratio of the second pulse width modulation signal PWM2 is reduced, the preliminary voltage-increasing part 413*a* varies the second gate-on voltage Von2 from the maximum gate-on voltage Von_Max to the reference gate-on voltage Von_ref during a predetermined period after the frame period starts, e.g., during the blank period of the frame period.

The second negative voltage generator 433 includes a preliminary voltage-decreasing part 433*a*. The preliminary voltage-decreasing part 433*a* receives the second input voltage Vin2 and the second pulse width modulation signal PWM2 to convert the second input voltage Vin2 to the second gate-off voltage Voff2. The preliminary voltage-decreasing part 433*a* decreases the second gate-off voltage Voff2 to the minimum gate-off voltage Voff_Min in response to the second pulse width modulation signal PWM2 during the blank period of the previous frame period before the frame period starts. Then, when the duty ratio of the second pulse width modulation signal PWM2 is increased, the preliminary voltage-decreasing part 433*a* varies the second gate off voltage Voff2 from the minimum gate-off voltage Voff_Min to the reference gate-off voltage Voff_ref during a predetermined period after the frame period 1F starts, e.g., during the blank period 1B of the frame period 1F.

As shown in FIG. 7, the gate lines GL1 to GLn (refer to FIG. 1) are sequentially scanned from the n-th gate line GLn to the first gate line GL1 during the negative scan operation after the high period of the vertical start signal STV indicating the start of a scan period 1S of the frame period 1F is generated.

The compensation control signal SC is generated at the high state or level in synchronization with the rising timing of the vertical start signal STV and transited to the low state or level at the predetermined timing before the next frame period starts. Here, the high period H_P of the compensation control signal SC corresponds to a compensation period in which the second gate-on voltage Von2 and the second gate-off voltage Voff2 are compensated and the low period L_P of the compensation control signal SC corresponds to a preliminary voltage-increasing period of the second gate-on voltage Von2 and a preliminary voltage-decreasing period of the second gate-off voltage Voff2.

In an exemplary embodiment, as shown in FIG. 7, the duty ratio of the second pulse width modulation signal PWM2 is varied in the high period H_P of the compensation control signal SC. The first pulse width modulation signal PWM1 shown in FIG. 5 has a duty ratio non-linearly increasing in the high period H_P and the second pulse width modulation signal PWM2 shown in FIG. 7 has a duty ratio non-linearly decreasing in the high period H_P.

In one exemplary embodiment, for example, the second gate-on voltage Von2 has k inflection points, e.g., four inflection points including first to fourth inflection points IP1 to IP4 (k is an integer equal to or greater than 1) and is non-linearly decreased in the high period H_P of the compensation control signal SC. The number of the inflection points IP1 to IP4 is determined depending on the specification of the display apparatus 500 and the number of the driving chips. The reduction of the second gate-on voltage Von2 from the maximum gate-on voltage Von_Max may be substantially the same as a curved line in symmetric with the first gate-on voltage Von1 with respect to the electric potential axis at the k-th inflection point IP4. That is, when the negative and positive scan operations are performed by the same display apparatus, the duty ratio of each of the first and second pulse width modulation signals PWM1 and PWM2 is set to allow a difference in the voltage delay between the negative scan operation and the positive scan operation to be reduced.

Other features of the second gate-on voltage Von2 are substantially similar to those of the first gate-on voltage Von1, and any repetitive detailed description thereof will be omitted or simplified.

The second gate-off voltage Voff2 has k inflection points IP1 to IP4 (k is an integer equal to or greater than 1) and is non-linearly increased in the high period H_P of the compensation control signal SC. The increase of the second gate-off voltage Voff2 from the minimum gate-off voltage Voff_Min may be substantially the same as a curved line in symmetric with the first gate-off voltage Voff1 with respect to the electric potential axis at the k-th inflection point IP4. That is, when the negative and positive scan operations are performed by the same display apparatus, the duty ratio of each of the first and second pulse width modulation signals PWM1 and PWM2 is set to allow the difference in the voltage delay between the negative scan operation and the positive scan operation to be reduced.

Other features of the second gate-off voltage Voff2 are substantially similar to those of the first gate-off voltage Voff1, and any repetitive detailed description thereof will be omitted.

Figure 8A:
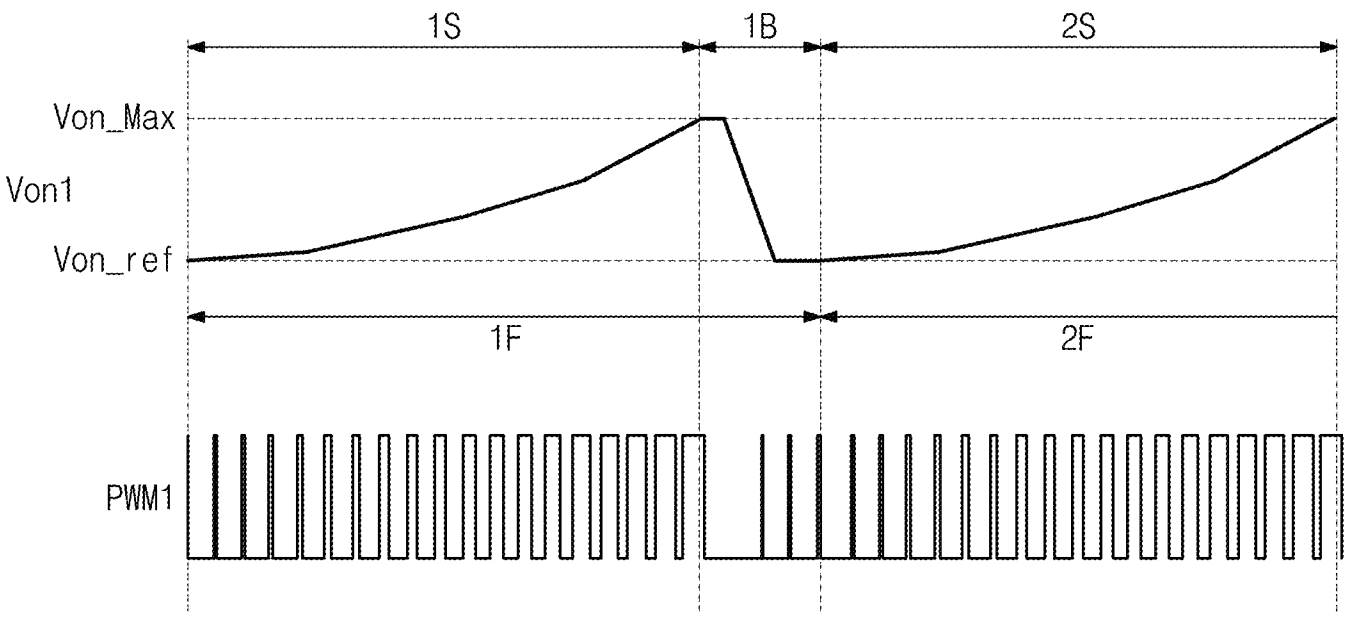
FIG. 8A is a waveform diagram showing a variation in a first gate-on voltage according to a first pulse width modulation signal in an exemplary embodiment of a display apparatus.
Figure 8B:
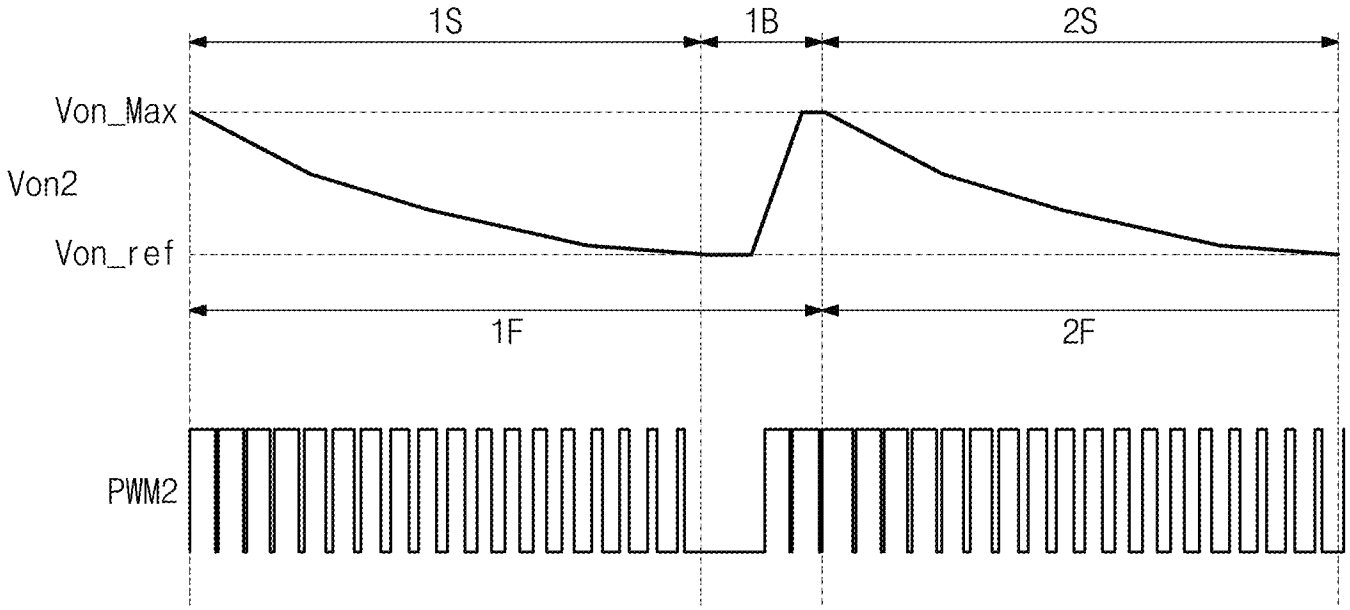
FIG. 8B is a waveform diagram showing a variation in a second gate-on voltage according to a second pulse width modulation signal in an exemplary embodiment of a display apparatus.

FIG. 8A is a waveform diagram showing the variation in the first gate-on voltage according to the first pulse width modulation signal, and FIG. 8B is a waveform diagram showing the variation in the second gate-on voltage according to the second pulse width modulation signal.

Referring to FIG. 8A, the first gate-on voltage Von1 is non-linearly increased from the reference gate-on voltage Von_ref to the maximum gate-on voltage Von_Max during each of frame periods 1F and 2F. The electric potential of the first gate-on voltage Von1 is varied according to the duty ratio of the first pulse width modulation signal PWM1. That is, as the duty ratio of the first pulse width modulation signal PWM1 increases, the electric potential of the first gate-on voltage Von1 increases.

The duty ratio of the first pulse width modulation signal PWM1 is increased by a constant rate in each linear period (refer to FIG. 5), and the increasing rate of the duty ratio between the two linear periods adjacent to each other may vary.

Referring to FIG. 8B, the second gate-on voltage Von2 is non-linearly decreased from the maximum gate-on voltage Von_Max to the reference gate-on voltage Von_ref during each of the frame periods 1F and 2F. The electric potential of the second gate-on voltage Von2 is varied according to the duty ratio of the second pulse width modulation signal PWM2. That is, as the duty ratio of the second pulse width modulation signal PWM1 decreases, the electric potential of the second gate-on voltage Von2 decreases. The second gate-on voltage Von2 is preliminary boosted to the maximum gate-on voltage Von_Max by the second pulse width modulation signal PWM2 having a maximum duty ratio right before each of the frame periods 1F and 2F starts. Then, the duty ratio of the second pulse width modulation signal PWM2 is reduced, and the second gate-on voltage Von2 is decreased to the reference gate-on voltage Von_ref.

Figure 9:
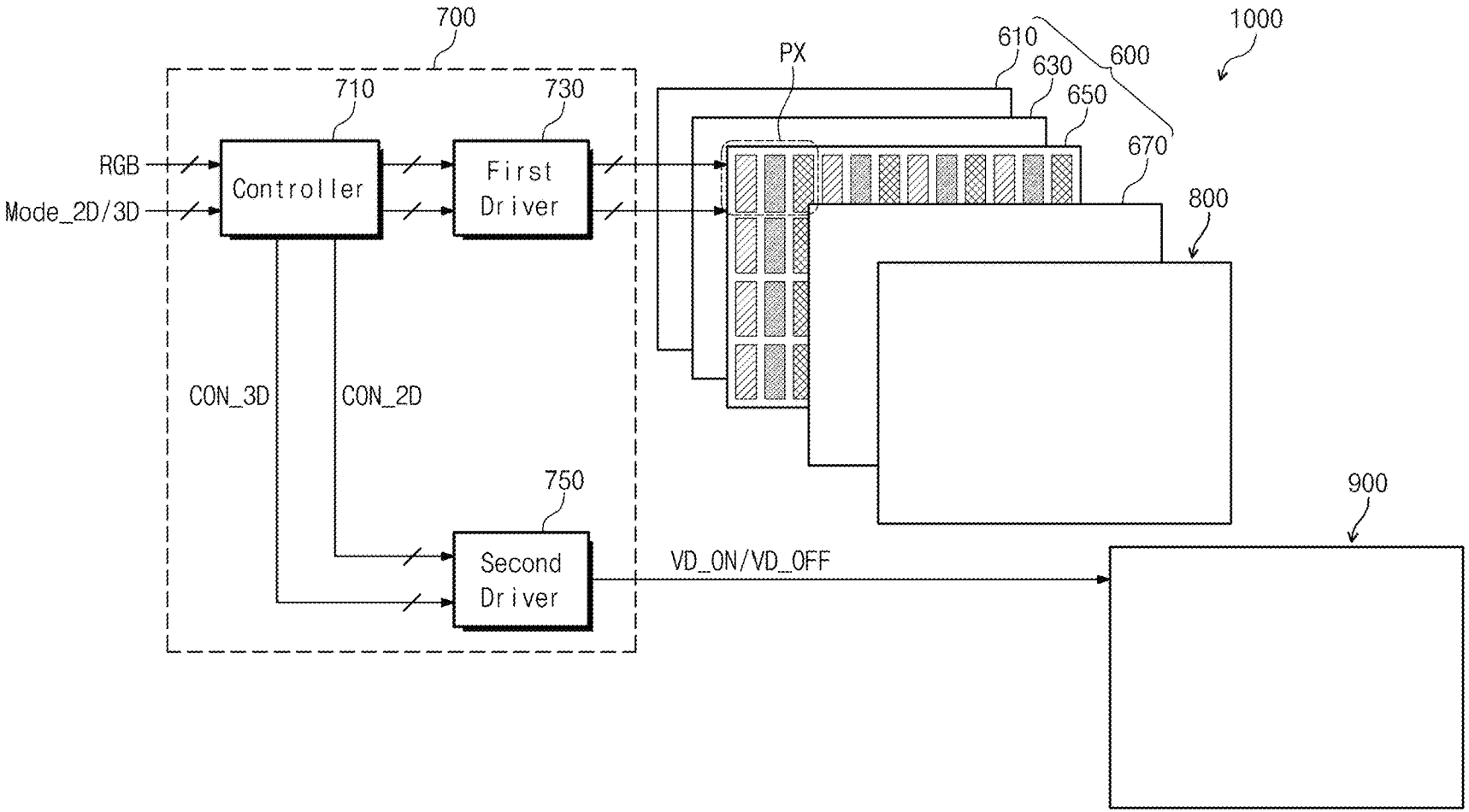
FIG. 9 is a block diagram showing an exemplary embodiment of a three-dimensional image display apparatus according to the invention.

FIG. 9 is a block diagram showing an exemplary embodiment of a three-dimensional ("3D") image display apparatus 1000 according to the invention.

Referring to FIG. 9, an exemplary embodiment of the 3D image display apparatus 1000 includes a display unit 600, a driving unit 700, a pattern retarder 800 and a switching panel 900.

The display unit 600 includes a display panel 650. The display panel 650 may be, but not limited to, a flat display panel, such as a liquid crystal display panel, a plasma display panel and an electroluminescence device including an organic light emitting diode, for example.

In an exemplary embodiment, where the display panel 650 is the liquid crystal display panel, the display unit 600 further includes a backlight unit 610 disposed under the display panel 650, a lower polarizing film 630 disposed between the display panel 650 and the backlight unit 610, and an upper polarizing film 670 disposed between the display panel 650 and the pattern retarder 800.

The display panel 650 operates in a two-dimensional ("2D") mode or a 3D mode in response to the control of the driving unit 700 to display the image. The driving unit 700 includes a controller 710, a first driver 730 that drives the display panel 650, and a second driver 750 that drives the switching panel 900. The controller 710 controls an operation of the first driver 730 and drives the second driver 750 in synchronization with the first driver 730.

In such an embodiment, the first driver 730 may include a data driver, a gate driver, a gate compensating circuit, and a voltage generating circuit. Hereinafter, features of the data driver, the gate driver, the gate compensating circuit, and the voltage generating circuit of an exemplary embodiment shown in FIG. 9, which are from those of the embodiments described above with reference to FIG. 1, will be described in detail.

In an exemplary embodiment, the data driver converts digital video data having a 3D data format, which are provided from the controller 710 during the 3D mode, to analog gamma voltages to generate 3D data voltages. In such an embodiment, the data driver converts digital video data having a 2D data format, which are provided from the controller 710 during the 2D mode, to analog gamma voltages to generate 2D data voltages.

The controller 710 controls the first driver 730 to allow the display panel 650 to operate in the 2D or 3D mode in response to 2D/3D mode selection signals Mode_2D/Mode_3D from a user interface or 2D/3D identification codes extracted from input image signals.

The controller 710 generates timing control signals using timing signals, such as a vertical synchronization signal, a horizontal synchronization signal, a main clock and a data enable signal, for example, to control an operation timing of the first driver 730. The controller 710 integer-multiplies the timing control signals to drive the first driver 730 at a frequency of about N×60 hertz (Hz) (N is an integer equal to or greater than 1), e.g., about 120 Hz, which is two times greater than an input frame frequency.

The backlight unit 610 includes a light source and a plurality of optical members that converts the light from the light source to a surface light source and irradiates the surface light source to the display panel 650. The light source includes one or more of a hot cathode fluorescent lamp ("HCFL"), a cold cathode fluorescent lamp ("CCFL"), an external electrode fluorescent lamp ("EEFL"), a flange focal length ("FFL"), and a light emitting diode ("LED"). The optical members may include a light guide plate, a diffusion plate, a prism sheet, and a diffusion sheet to improve a surface uniformity of the light from the light source.

The switching panel 900 includes a first substrate, a second substrate disposed opposite to the first substrate, and a liquid crystal layer interposed between the first and second substrates. Each of the first and second substrate includes an insulating material, e.g., glass, plastic, etc. A polarizing film (not shown) may be further disposed on an outer side surface of the switching panel 900.

The controller 710 applies a first control signal CON_2D to the second driver 750 such that the switching panel 900 operates in an OFF state during the 2D mode and applies a second control signal CON_3D to the second driver 750 such that the switching panel 900 operates in an ON state during the 3D mode.

The second driver 750 generates a first driving voltage VD_ON or a second driving voltage VD_OFF based on the first and second control signals CON_2D and CON_3D and applies the first driving voltage VD_ON or the second driving voltage VD_OFF to the switching panel 900. Accordingly, the switching panel 900 receives the second driving voltage VD_OFF from the second driver 750 during the 2D mode, and thus the switching panel 900 may not operate as a liquid crystal lens. During the 3D mode, the switching panel 900 receives the first driving voltage VD_ON from the second driver 750, and thus the switching panel 900 operates as the liquid crystal lens.

Therefore, in such an embodiment, the switching panel 900 transmits the image displayed in the display panel 650 without separation of a visual field during the 2D mode, and performs the separation of the visual field on the image displayed in the display panel 650 during the 3D mode.

Figure 10A:
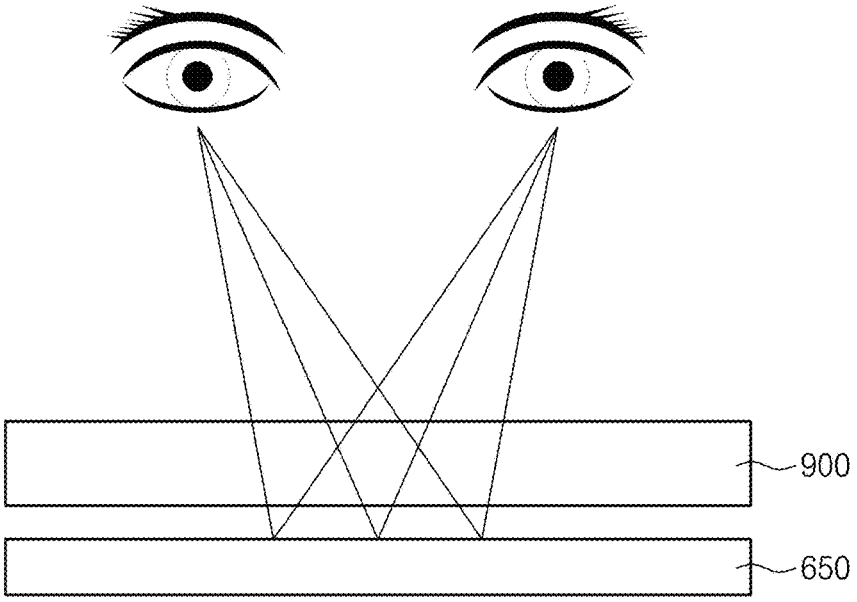
FIGS. 10A and 10B are views showing an exemplary embodiment of a method of forming a two-dimensional image and a three-dimensional image of an image display apparatus, according to the invention.
Figure 10B:
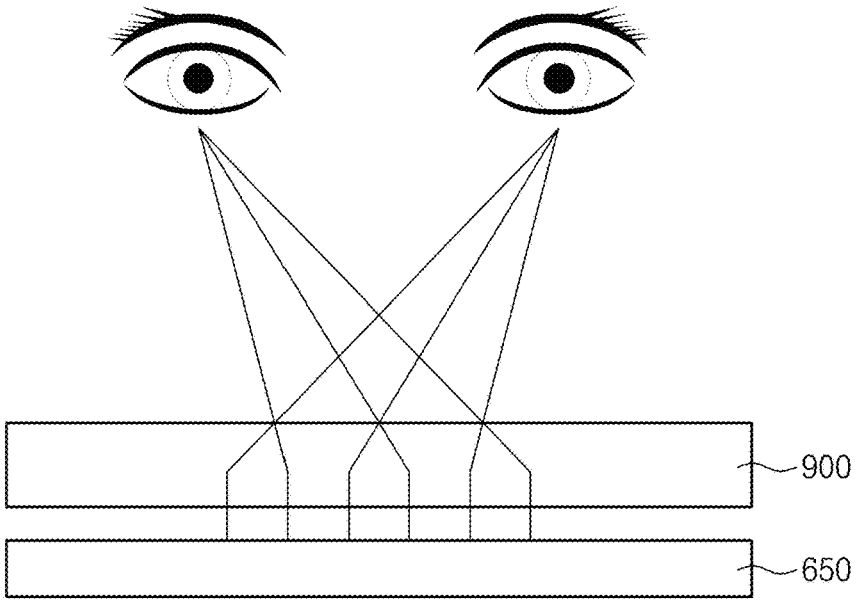

FIGS. 10A and 10B are views showing an exemplary embodiment of a method of forming a two-dimensional image and a three-dimensional image of an image display apparatus, according to the invention. For convenience of illustration, FIGS. 10A and 10B show only the display panel 650 and the switching panel 900 among elements shown in FIG. 9.

Referring to FIGS. 10A and 10B, the display panel 650 displays one 2D image during the 2D mode, but alternately displays images corresponding to various visual fields, e.g., a left-eye image, a right-eye image, etc., through spatial-division-multiplexing schemes or time-division-multiplexing scheme in the 3D mode. In one exemplary embodiment, for example, the display panel 650 alternately displays the right-eye image and the left-eye image every pixel in one column.

The switching panel 900 transmits the image displayed in the display panel 650 without the separation of the visual field of the image during the 2D mode and separates the visual field of the image displayed in the display panel 650 during the 3D mode. That is, the switching panel 900 that operates in the 3D mode includes the left-eye image and the right-eye image, which are displayed in the display panel 650. Thus, a viewpoint image falls on a corresponding visual field in each viewpoint by refraction and diffraction of the light.

FIG. 10A shows the display panel 650 and the switching panel 900, which operate in the 2D mode, and the same image is provided to left and right eyes of a user. As a result, the user recognizes the 2D image. FIG. 10B shows the display panel 650 and the switching panel 900, which operate in the 3D mode, and the image displayed in the display panel 650 is separated in the visual field such as left and right eyes and refracted. As a result, the user recognizes the 3D image.

Figure 11:
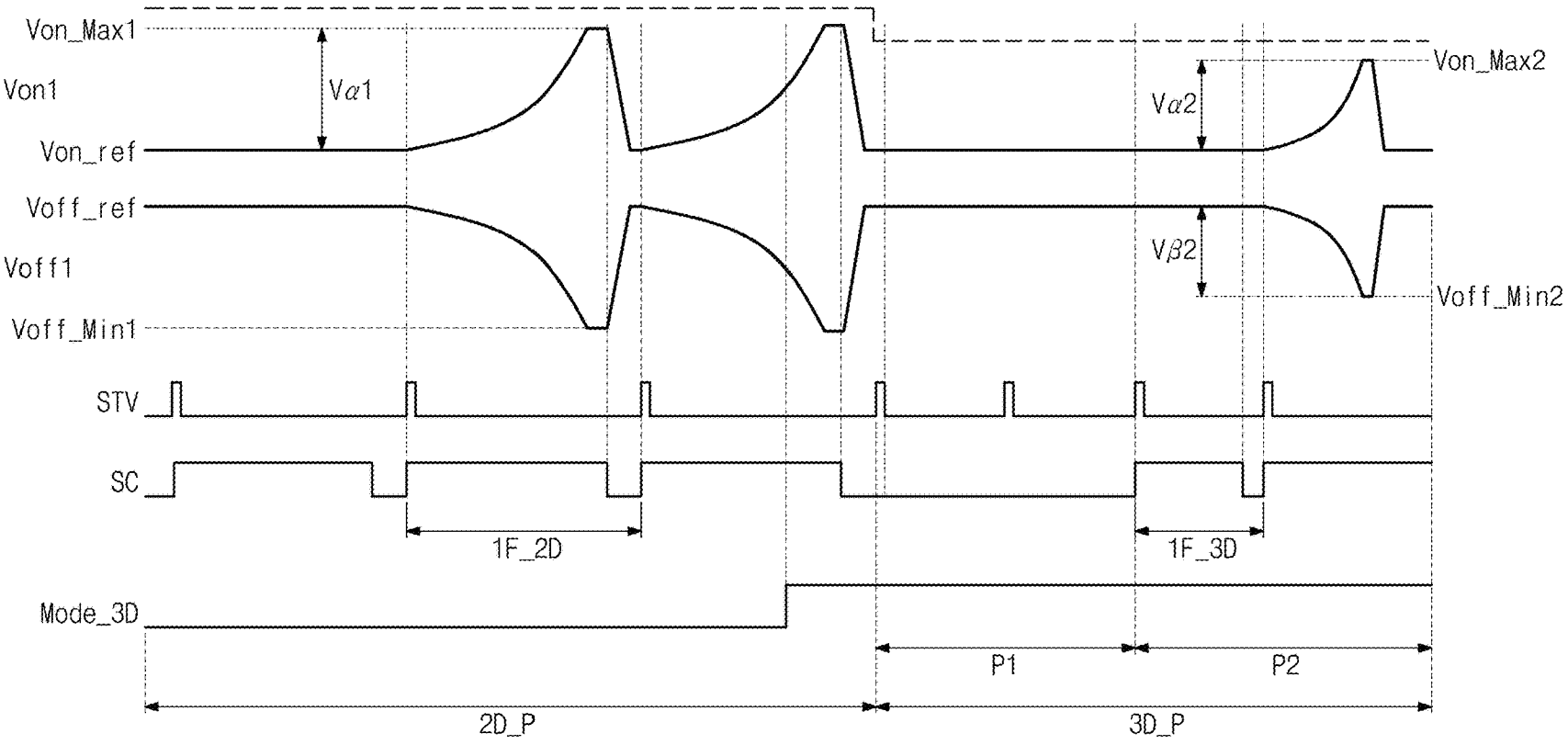
FIG. 11 is a waveform diagram showing an electric potential of an exemplary embodiment of the first gate-on voltage and the first gate-off voltage in a positive scan operation.

FIG. 11 is a waveform diagram showing an electric potential of an exemplary embodiment of the first gate-on voltage and the first gate-off voltage in a positive scan operation.

Referring to FIG. 11, an exemplary embodiment of the 3D image display apparatus 1000 operates at a first frequency during the 2D mode and operates at a second frequency higher than the first frequency during the 3D mode. In one exemplary embodiment, for example, the 3D image display apparatus 1000 operates at a frequency of about 60 Hz during the 2D mode and operates at a frequency of about 120 Hz during the 3D mode.

The gate compensating circuit 300 controls the frequency of the compensation control signal SC in accordance with frequency information of the 3D image display apparatus 1000. A period in which the first driver 730 operates in the 2D mode is referred to as a 2D period 2D_P, and a period in which the first driver 730 operates in the 3D mode is referred to as a 3D period 3D_P. The 3D mode selection signal Mode_3D has a low state in the 2D period 2D_P and has a high stage in the 3D period 3D_P, but the 3D mode selection signal Mode_3D may be transited to the high state prior to a time point at which the first driver 730 operates in the 3D mode.

The vertical start signal STV has the frequency of about 60 Hz during the 2D period 2D_P and has the frequency of about 120 Hz during the 3D period 3D_P. Accordingly, a width of a frame period 1F_2D in the 2D period 2D_P is greater than a width of a frame period 1F_3D in the 3D period 3D_P. Hereinafter, the frame period of the 2D period 2D_P is referred to as a 2D frame period 1F_2D and the frame period of the 3D period 3D_P is referred to as a 3D frame period 1F_3D.

The compensation control signal SC has the frequency of about 60 Hz during the 2D period 2D_P, is maintained at a low level during a first period P1 of the 3D period 3D_P, and has the frequency of about 120 Hz during a second period P2 of the 3D period 3D_P. The first period P1 corresponds to a period including several pervious frames when the 2D mode is changed to the 3D mode. In an exemplary embodiment, the first period P1 may have a width corresponding to two 3D frame periods.

As shown in FIG. 11, the first gate-on voltage Von1 increases to a first maximum gate-on voltage Von_Max1 in the 2D period 2D_P, which is increased by a first compensation value Vα1 compared to the reference gate-on voltage Von_ref. The first gate-on voltage Von1 increases to a second maximum gate-on voltage Von_Max2 in the 3D period 3D_P, which is increased by a second compensation value Vα2 compared to the reference gate-on voltage Von_ref. In an exemplary embodiment, the first compensation value Vα1 may be equal to or greater than the second compensation value Vα2.

The 2D frame period 1F_2D is longer than the 3D frame period 1F_3D in a time width, such that the first compensation value Vα1 may be allowed to be greater than the second compensation value Vα2.

The first gate-off voltage Voff1 decreases to a first minimum gate-off voltage Voff_Min1 in the 2D period 2D_P, which is decreased by a third compensation value Vβ1 compared to the reference gate-off voltage Voff_ref. The first gate-off voltage Voff1 decreases to a second minimum gate-off voltage Voff_Min2 in the 3D period 3D_P, which is decreased by a fourth compensation value Vβ2 compared to the reference gate-off voltage Voff_ref. In an exemplary embodiment, the third compensation value Vβ1 may be equal to or greater than the fourth compensation value Vβ2.

The 2D frame period 1F_2D is longer than the 3D frame period 1F_3D in the time width, such that the third compensation value Vβ1 may be allowed to be greater than the fourth compensation value Vβ2.

Figure 12:
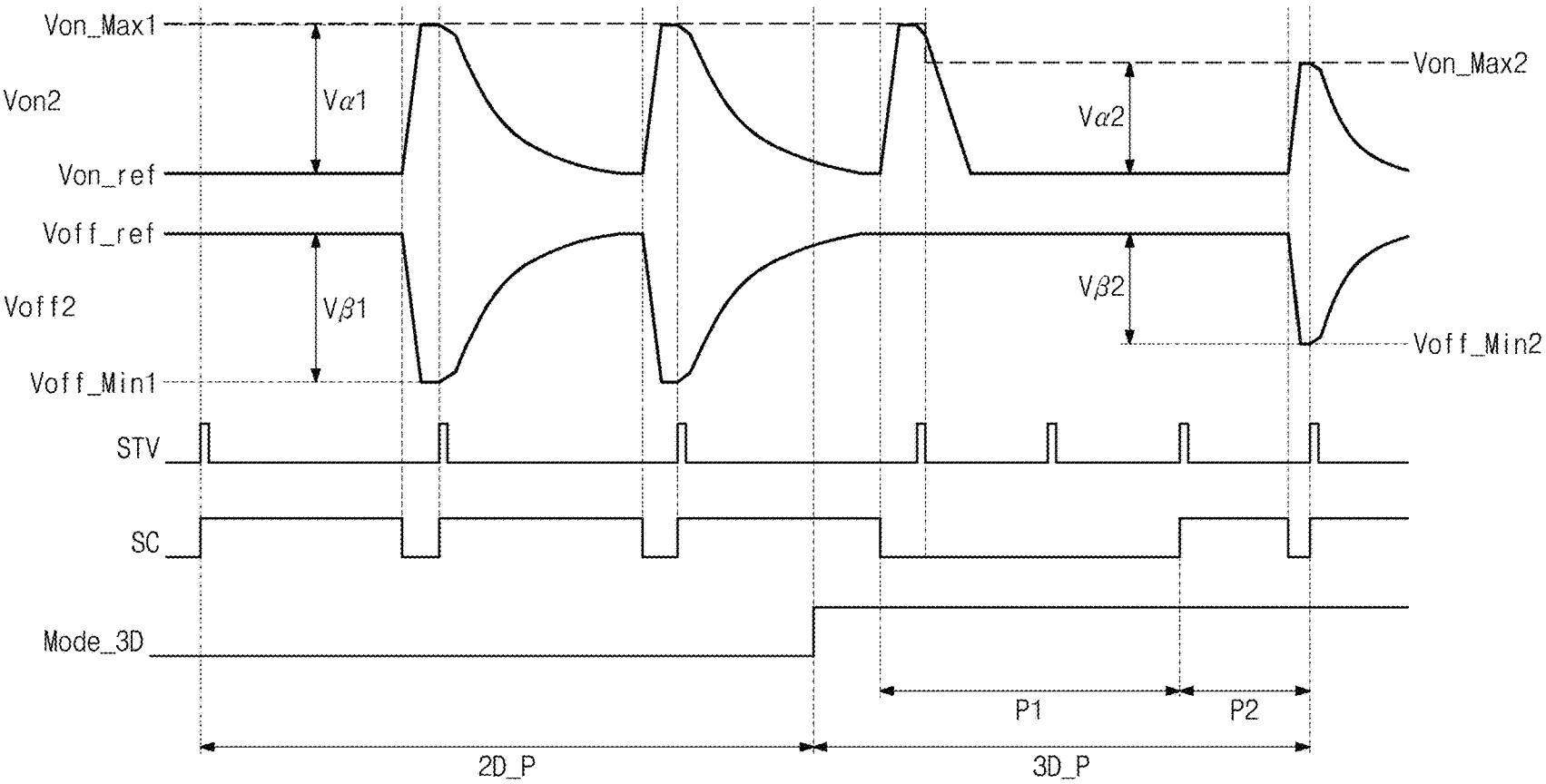
FIG. 12 is a waveform diagram showing an electric potential of an exemplary embodiment of the second gate-on voltage and the second gate-off voltage in a negative scan operation.

FIG. 12 is a waveform diagram showing an electric potential of an exemplary embodiment of the second gate-on voltage and the second gate-off voltage in a negative scan operation. In FIG. 12, the same reference numerals denote the same elements in FIG. 11, and any repetitive detailed description thereof will be omitted.

Referring to FIG. 12, the second gate-on voltage Von2 decreases from the first maximum gate-on voltage Von_Max1 increased by the first compensation value Vα1 compared to the reference gate-on voltage Von_ref to the reference gate-on voltage Von_ref during a frame period in the 2D period 2D_P. The second gate-on voltage Von2 decreases from the second maximum gate-on voltage Von_Max2 increased by the second compensation value Vα2 compared to the reference gate-on voltage Von_ref to the reference gate-on voltage Von_ref in the 3D period 3D_P. In one exemplary embodiment, for example, the first compensation value Vα1 is equal to or greater than the second compensation value Vα2.

The second gate-off voltage Voff2 decreases to a first minimum gate-off voltage Voff_Min1 in the 2D period 2D_P, which is decreased by the third compensation value Vβ1 compared to the reference gate-off voltage Voff_ref. The first gate-off voltage Voff1 decreases to a second minimum gate-off voltage Voff_Min2 in the 3D period 3D_P, which is decreased by the fourth compensation value Vβ2 compared to the reference gate-off voltage Voff_ref. In an exemplary embodiment, the third compensation value Vβ1 is equal to or greater than the fourth compensation value Vβ2.

Although some exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display apparatus comprising:

a voltage generating circuit which generates a driving voltage;

a data driver which generates data voltages;

a gate driver which receives the driving voltage from the voltage generating circuit to generate gate signals; and a display panel comprising data lines which receive the data voltages from the data driver;

gate lines which receive the gate signals from the gate driver; and pixels connected to the data lines and gate lines, wherein the driving voltage comprises a first driving voltage which determines a high level of each of the gate signals and a second driving voltage which determines a low level of each of the gate signals, the voltage level of the first and second driving voltages non-linearly varies during a frame period, the gate signals have high levels different from each other during the frame period by the first driving voltage and low levels different from each other during the frame period by the second driving voltage.

2. The display apparatus of claim 1, wherein the gate lines comprise first to n-th gate lines arranged in a first direction, and the gate driver sequentially scans the first to n-th gate lines along the first direction during the frame period.

3. The display apparatus of claim 2, wherein the first driving voltage is non-linearly increased during the frame period and the second driving voltage is non-linearly decreased during the frame period.

4. The display apparatus of claim 3, wherein the voltage generating circuit comprises:

a first voltage generator which generates the first driving voltage; and a second voltage generator which generates the second driving voltage, wherein the first voltage generator comprises a first positive voltage generator which non-linearly increases the first driving voltage from a first reference voltage to a first maximum voltage during the frame period, and the second voltage generator comprises a second positive voltage generator which non-linearly decreases the second driving voltage from a second reference voltage to a first minimum voltage during the frame period.

5. The display apparatus of claim 4, wherein the first positive voltage generator comprises:

a voltage-increasing part which increases the first driving voltage from the first reference voltage to the first maximum voltage; and a discharging part which discharges the first driving voltage to the first reference voltage.

6. The display apparatus of claim 4, wherein the second positive voltage generator comprises:

a voltage-decreasing part which decreases the second driving voltage from the second reference voltage to the first minimum voltage; and a boosting part which boosts the second driving voltage to the second reference voltage.

7. The display apparatus of claim 4, wherein the frame period comprises:

a scan period during which the first to n-th gate lines are scanned; and a blank period disposed between the scan period and a scan period of a next frame.

8. The display apparatus of claim 7, wherein each of the first driving voltage and the second driving voltage comprises k inflection points and is non-linearly increased or decreased during the frame, wherein k is an integer equal to or greater than 1, the frame period is divided into k+1 linear periods, and a variation in voltage of each of the first driving voltage and the second driving voltage is constant in each of the linear periods.

9. The display apparatus of claim 8, wherein the first driving voltage and the second driving voltage have $2^x$ unit-time periods on a time axis during the frame period, wherein x is an integer equal to or greater than 1, and each of the linear periods comprises at least one of the unit-time period.

10. The display apparatus of claim 7, wherein an electric potential period between the first maximum voltage and the first reference voltage comprises $2^y$ unit time periods during the frame, wherein y is an integer equal to or greater than 1, a difference value between the first maximum voltage and the first reference voltage is $\alpha$, and an electric potential difference between adjacent unit electric potential periods is about $\alpha/2^y$.

11. The display apparatus of claim 7, wherein an electric potential period between the second reference voltage and the first minimum voltage comprises $2^y$ unit-time periods during the frame, wherein y is an integer equal to or greater than 1, a difference value between the second reference voltage and the first minimum voltage is $\beta$, and an electric potential difference between adjacent unit electric potential periods is about $\beta/2^y$.

12. The display apparatus of claim 1, wherein the gate lines comprise first to n-th gate lines arranged in a first direction, and the gate driver sequentially scans the first to n-th gate lines along a second direction during the frame period, wherein the second direction is opposite to the first direction.

13. The display apparatus of claim 12, wherein the first driving voltage is non-linearly decreased during the frame period and the second driving voltage is non-linearly increased during the frame period.

14. The display apparatus of claim 13, wherein the voltage generating circuit comprises:

a first voltage generator which generates the first driving voltage; and a second voltage generator which generates the second driving voltage, wherein the first voltage generator comprises a first negative voltage generator which non-linearly decreases the first driving voltage from a first maximum voltage to a first reference voltage during the frame period, and the second voltage generator comprises a second negative voltage generator which non-linearly increases the second driving voltage from a first minimum voltage to a second reference voltage during the frame period.

* * * * *